United States Patent [19]

Hasegawa et al.

[11] Patent Number: 4,549,587

[45] Date of Patent: Oct. 29, 1985

[54] VENEER LATHE

[75] Inventors: Katsuji Hasegawa, Nagoya; Yasuhiro Ibuki, Ohbu, both of Japan

[73] Assignee: Meinan Machinery Works, Inc., Ohbu, Japan

[21] Appl. No.: 495,113

[22] Filed: May 16, 1983

[30] Foreign Application Priority Data

May 14, 1982 [JP] Japan ..... 57-081976

[51] Int. Cl.[4] ..... B27L 5/00; B27B 1/00

[52] U.S. Cl. ..... 144/209 R; 82/40 R; 82/47

[58] Field of Search ..... 82/40, 47; 29/26 A, 29/564.2; 144/209 R, 209 A

[56] References Cited

U.S. PATENT DOCUMENTS

| | | | |
|---|---|---|---|
| 3,152,626 | 10/1964 | Nicholson | 144/209 R |
| 4,141,397 | 2/1979 | Schmidt | 144/209 R |
| 4,356,850 | 11/1982 | Halgrimson et al. | 144/209 R |
| 4,413,540 | 11/1983 | Burge | 144/209 R |

*Primary Examiner*—W. D. Bray

*Attorney, Agent, or Firm*—Armstrong, Nikaido, Marmelstein & Kubovcik

[57] ABSTRACT

A veneer lathe for turning the log by means of a rotary roller which is capable of continuing the cutting operation until the log being cut comes to have a diameter practically the same as the spindle diameter. Said veneer lathe comprises a boring unit, centering unit, a spindle conveying mechanism for conveying the log from the boring unit to the spindle means, rotary drive roller to turn the log and means for guiding the spindles and stopping the log movement. The log is formed with center bores by the boring unit. Through said center bores, the spindles are inserted to prevent the log from deflecting under the pressing force of the rotary roller. Upon completion of the turning operation, the spindles are removed out of the centerbores while the spindle guiding and log stopping means prevents the log from following the spindle removing action.

10 Claims, 17 Drawing Figures

VENEER LATHE

BACKGROUND OF THE INVENTION

The present invention relates to a veneer lathe improved on the basis of a new technical idea.

In most conventional veneer lathes, driving force is exerted on the butt ends of a log by means of the chucks of spindles which grips the butt ends directly. In such a veneer lathe, since the radius of the chuck is too small as compared with the radius of a log, the gripped butt ends of the log cannot withstand the cutting resistance of a cutting knife and thereby the torsional breakage of the butt ends and the fructure of the log are liable to occur frequently. Therefore, most logs cannot be turned to a diameter as great as the diameter of the spindles.

In order to overcome above-mentioned disadvantages of conventional veneer lathes, the applicant of the present invention developed and proposed a new veneer lathe as disclosed in Japanese Patent Publication No. 56-16729, which comprises a rotary roller provided with a plurality of driving members each having a plurality of spikes, the driving members being arranged axially on the rotary roller at suitable intervals, the rotary roller being disposed practically in parallel with the cutting edge of a cutting knife at a position where the spikes can bite into the circumference of a log near the cutting edge during cutting operation; a driving mechanism for driving the rotary roller; and pressure members, such as fixed bars or rollers, disposed at least part of a plurality of interspaces formed between the driving members of the rotary roller.

In the above-mentioned new veneer lathe, since driving force is exerted on the periphery of a log near the cutting edge of the cutting knife through the driving members of the rotary roller, at least part of the driving force to be conventionally exerted by the spindles on the log can be omitted, the breakage of a log due to the concentration of stress on the chucked butt ends can be prevented, and the breakage of a log due to the clogging of a space between the periphery of the log and the pressure members with foreign matters such as the bark of logs and wood chips is prevented and hence almost every log can be turned down to about the diameter (usually, about 100 mm for logs of 1 m in length) of the spindles and thereby the yield of veneer sheets is improved remarkably.

Although the stripping of logs down to the diameter of about 100 mm for a log of 1 m in length was considered acceptable enough in times when logs of comparatively large outside diameters were readily available. However, it is not sufficient today when large-diameter logs are hardly available, much less in the future when the outside diameters of available logs will be reduced still further. Accordingly, further stripping of logs beyond the above mentioned level is desired as a matter of course.

Nevertheless, even in the above-mentioned new veneer lathe, it has been difficult to cut the log to a further reduced outside diameter thereof only by simply reducing the outside diameter of the spindles because various factors which will be described afterward forestall such a scheme. That is, the geometrical engagement between the periphery of a log and the driving members of the rotary roller decreases sharply as the outside diameter of the log decreases. On the other hand, the spikes of the driving members must be made to bite considerably deeply into the circumference of the log in order to secure the transmission of driving force necessary for turning operation. As a result the log is subjected to an increased pressure from the roller. Furthermore the deflection of a cylindrical log increases, as well known, in inverse proportion to the fourth power of the outside diameter thereof. More specifically, the deflection of the log increases sharply when the outside diameter of the log is reduced below 100 mm until finally the log is broken during turning operation or veneer sheets of irregular thickness unsuitable for use are produced. The existance of radial cracks extending from the core of a log, which are seen in the butt ends of ordinary logs, is a significant factor causing the log breakage when the outside diameter of the log is extremely small and is an additional impediment to turning a log to a further reduced outside diameter.

SUMMARY OF THE INVENTION

The present invention provides an improved veneer lathe developed through the improvement of the above-mentioned new veneer lathe, which improved veneer lathe is capable of cutting a log to a further reduced diameter, of effectively turning logs even if only small-diameter logs are available, of efficiently turning logs and of coping with the future supply conditions of logs, in which only logs of smaller diameters are available.

Other objects and features of the present invention will become apparent from the detailed description of preferred embodiments thereof, taken in connection with appended drawings.

One of the features of a veneer lathe according to the present invention is that a boring mechanism is provided at a suitable position on the log supplying side where a log centering device or a log supply device is located, to drill a center bore in the axial central portion of a log along a center axis (axis of rotation) of the log determined on the log centering device or on the log supply device and spindles conforming in dimension to the center bore are inserted into the center bore to support the log.

Setting aside the details of the spindles, which will be described hereinafter, various forms of engagement between the spindles and the center bore or center bores are possible; more specifically, inserting spindles each having a diameter that fits a center bore drilled through a log 1 into the center bore, inserting spindles each having a diameter that fits the corresponding bottomed center bore into the bottomed center bores drilled in a log along the center axis thereof, inserting spindles each having a length reaching the bottom surface of the corresponding bottomed center bore into the bottomed center bores formed in a log along the center axis thereof and inserting spindles each having a diameter that fits the inner circumference of the corresponding bottomed center bore formed in a log along the center axis thereof and a length reaching the bottom surface of the same bottomed center bore into the center bores. In either case, a log can be supported securely and firmly with spindles formed in a diameter and/or a length that fits the center bore or the center bores of the log. Furthermore, supporting a log in the axially inner portion thereof increases the apparent rigidity of the log and reduces the deflection (reduces in proportion to the third power of the length) of the log, so that appropriate engagement between the rotary roller and a log and appropriate turning operation are attained.

DETAILED DESCRIPTION OF THE EMBODIMENTS

Figure 1:
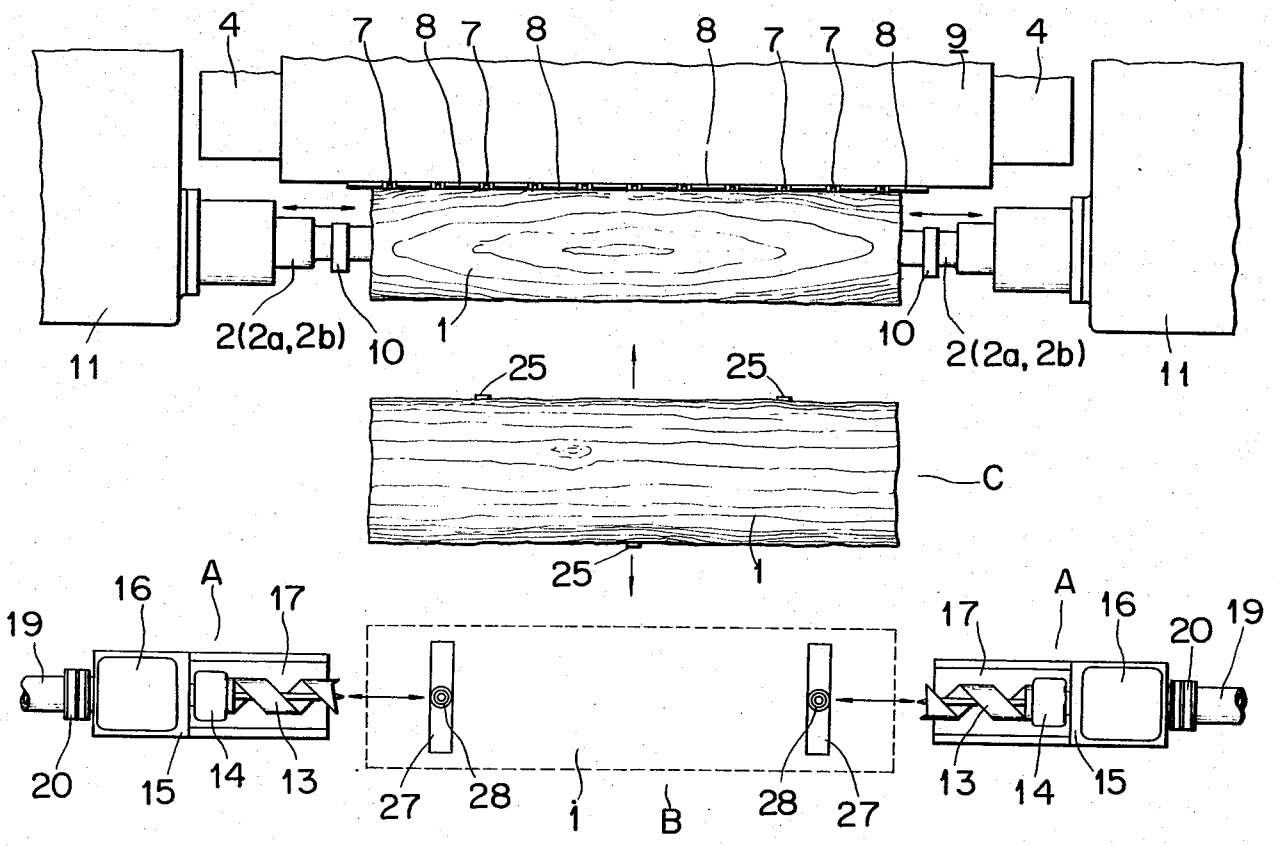
FIG. 1 is a partial plan view of an embodiment of a veneer lathe according to the present invention.
Figure 2:
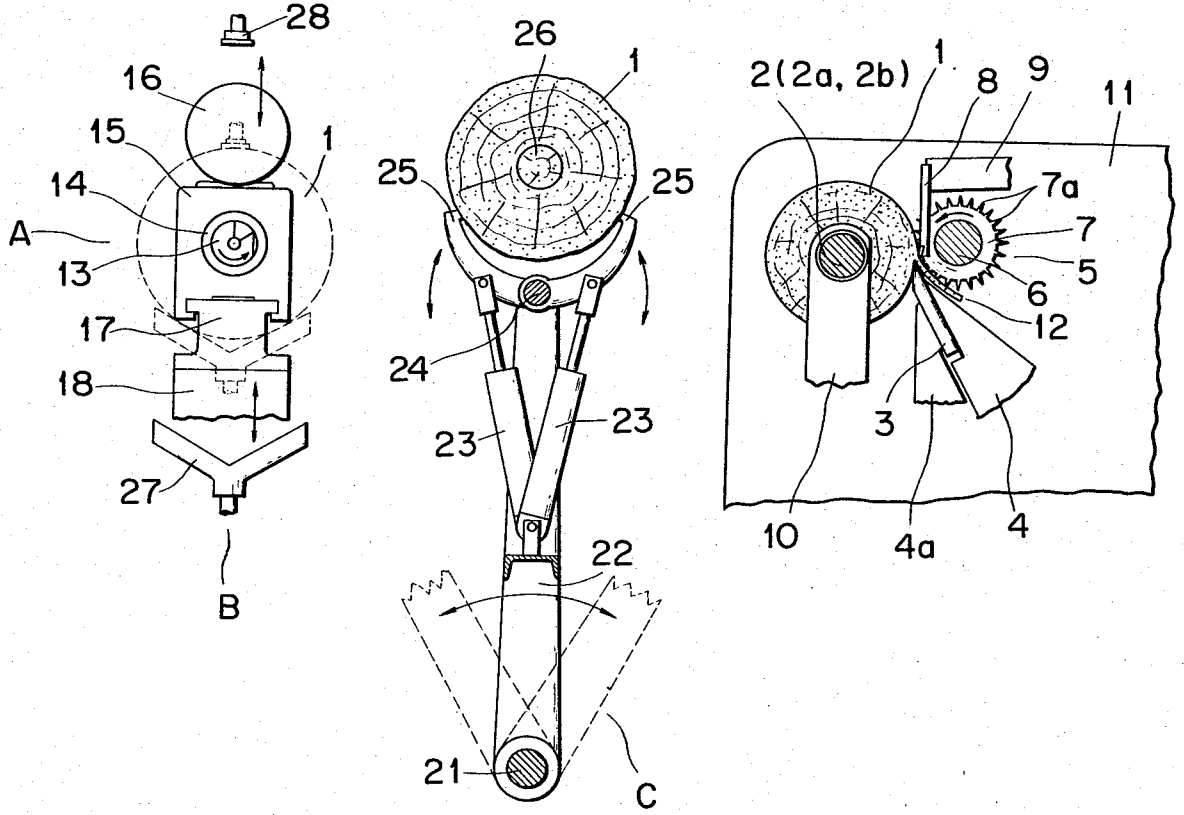
FIG. 2 is a sectional view of the veneer lathe of FIG. 1.
Figure 3:
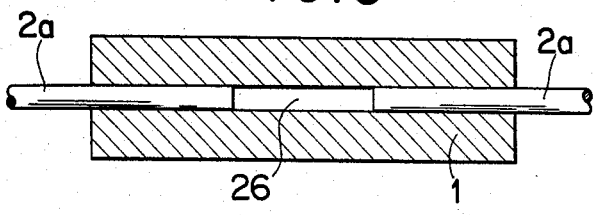
FIGS. 3 to 10 are schematic sectional views of logs and the spindles of the veneer lathe, for explaining the various manners of engagement between the spindles and a log.
Figure 4:
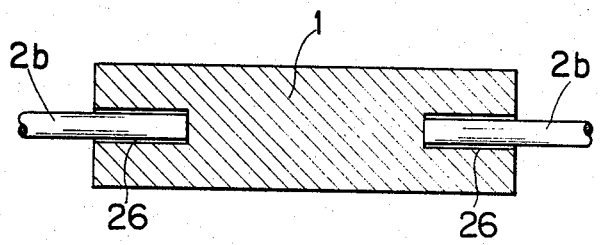

FIG. 1 is a partial plan view of an embodiment of a veneer lathe according to the present invention and FIG. 2 is a sectional view of FIG. 1. Referring to FIGS. 1 and 2, a cutting tool 3 is fixed with a tool holder 4*a* to a slide rest 4 adapted to be moved by the agency of a feed screw, not shown, toward the axis of a log 1 supported by spindles 2 (*2a, 2b*) rotatably supported in a frame 11 as the log 1 is rotated, to cut the log 1 to produce a veneer sheet 12. A rotary roller 5 is provided with a plurality of driving members 7 each having a plurality of spikes *7a* arranged over the periphery thereof. The driving members 7 are arranged at suitable axial intervals. The rotary roller 5 is disposed practically in parallel alignment with the edge line of the cutting tool 3 so as to enable the spikes *7a* to bite into the log periphery near the edge of the cutting tool 3 during the cutting operation and is driven by a driving mechanism, such as a motor, not shown, to exert the driving force on the periphery of the log 1 near the edge of the cutting tool 3. Divided fixed bars 8 are disposed between the interspaces between the driving members 7 of the rotary roller 5 respectively and are fixed to a pressure bar 9 adapted to be moved together with the slide rest 4 to press the log 1 near the boundary between the log 1 and the veneer sheet 12 being cut off. A log stopper or a support plate 10 is disposed adjacently to each butt end of the log 1 mounted on the spindles 2 for turning and is adapted to allow the axial movement of the corresponding spindle 2 and to restrict the axial movement of the log 1 within a limited range.

The boring mechanisms of the veneer lathe are indicated generally at A. The boring mechanism A has a chuck 14 rotatably supported by a bearing unit 15 adapted to be moved on and along a rail 17 mounted on a frame 18 by means of a hydraulic cylinder 19 and adapted to be rotated by a motor 16 through a belt 20. A woodworking drill 13 is held by the chuck 14 for movement in the directions of the arrows. The boring mechanism A is disposed on each side of a log centering device B. The log centering device B, as disclosed in the patent application "A LOG CENTERING DEVICE", filed in Japan on Apr. 14, 1982 by the applicant of the present invention, filing number 57-62993 (first publication number is 58-179604, published on Oct. 20, 1983) has a support 27 having a V-shaped log supporting surface and a presser 28 having a flat log pressing surface, which are disposed opposite to each other and are adapted to be moved toward and away from each other by means of hydraulic cylinders, not shown, and is designed to center a log supplied thereto by a conveyor system or the like by holding the log 1 from below and above with the support 27 and the pressure 28 therebetween as indicated by broken line in FIG. 2. The boring mechanisms A drill center bores 26 respectively in the axial central portion of the log 1 centered by the log centering device B.

A log supply device indicated generally at C has a pair of swing arms 22 disposed on opposite sides thereof, respectively, each adapted to be driven to swing on a shaft 21 between positions indicated by broken line in FIG. 2 by means of an operating mechanism including a cam and a hydraulic cylinder, not shown, and two pairs of gripping levers 25. The paired gripping levers 25 are turned on a shaft 24 by means of hydraulic cylinders 23 mounted on the corresponding swing arm 22 toward and away from each other. After a log 1 has been centered by the log centering device B and drilled by the boring mechanisms A to form center bores 26 in the axial central portion thereof, the gripping levers 25 grip the log 1 in the outer circumference thereof and the swing arms 22 are turned on the shaft 21 to transfer the log 1 from the log centering device B to the veneer lathe, where the log 1 is supported by the spindles 2 (*2a, 2b*).

An exemplary veneer lathe according to the present invention is constituted as described hereinbefore. In operation, the log centering device B centers a log 1, then the boring mechanisms A drill center bores 26 in the axial central portion of the log 1, then the log supply device C transfers the log 1 from the log centering device B to the veneer lathe, where the spindles 2 (*2a, 2b*) are inserted into the center bores 26 respectively to support the log 1 and then the log 1 is cut gradually with the cutting tool 3 to produce a veneer sheet 12 through the log driving operation of the spindles 2 (*2a, 2b*) and the rotary roller 5 and the advancement of the cutting tool 3.

In this cutting operation, since the line of action of the resistance of the cutting tool and associated members and the line of action of the counteracting driving force of the rotary roller are situated approximately in the same plane including center axis of the log and quite near to each other, the resistance and the driving force are well balanced and counterbalanced. Accordingly, the possibility of damage to the log attributable to the concentration of stress and of damage to the log attributable to the clogging of the space between the circumference of the log and the pressure members with foreign matters, as is often the case with the conventional veneer lathe, are reduced to the least. Furthermore, since drilling the center bores removes part or all of stress-induced cracks originally existing in the core of the log, damage to the log attributable to such cracks is prevented or reduced remarkably. Still further, since the log is supported by the spindles inserted into the center bores formed therein, namely, since the log is supported in the axially inner portion thereof, the deflection of the log is reduced as compared with the deflection of the log on the conventional veneer lathe and thereby the log breakage or the irregularity in veneer thickness is avoided. Furthermore, since the insertion of the spindles into the center bores increases the apparent rigidity of the log, the spikes of the driving members are made to bite into the circumference of the log more firmly without the fear of log deflection and hence the appropriate transmission of the driving force necessary to the turning operation is attained, the log can be cut to a smaller diameter, which has been impossible on the conventional veneer lathe, and veneer sheets of good quality can be produced.

Figure 6:
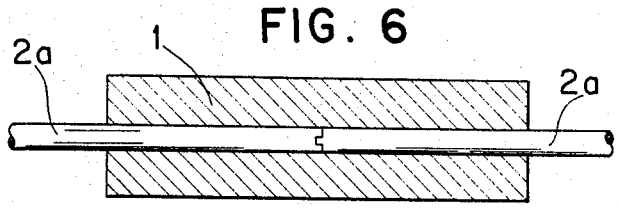
Figure 7:
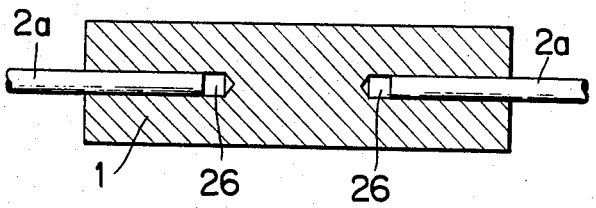
Figure 8:
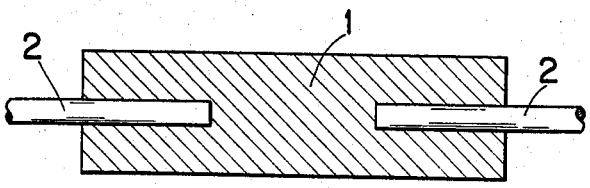

Incidentally, in an experimental cutting operation, a larch log of approximately 1 m in length having center bores of 5 cm in diameter and approximately 20 cm in depth formed in the opposite butt ends thereof was subjected to cutting on a veneer lathe provided with spindles of 5 cm in diameter on the opposite sides thereof, by being supported in the manner as shown in FIG. 6. The log could be cut to approximately 6 cm in diameter and good veneer sheets of a desired thickness were produced.

Figure 15:
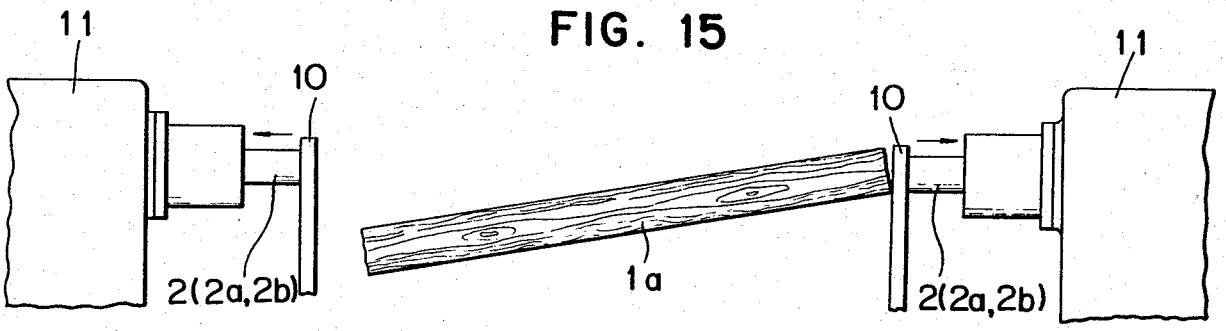
FIG. 15 is a plan view for facilitating the explanation of the manner of removing a stripped core from the spindles.

When the spindles are inserted into the center bores formed in a log to support the log, the stripped core of the log will remain naturally either on the right or on the left spindle even if the spindles are retracted to release the stripped core after the completion of the cutting operation. Consequently, the stripped core remaining on one of the spindles possibly obstructs the next supply of a log onto the veneer lathe and reduces the operating rate of the veneer lathe, and in some cases, the remaining stripped core possibly damages the log supply device, the spindles or the spikes of the rotary roller. In a veneer lathe according to the present invention, since a log stopper is disposed adjacently to each butt end of a log as mounted on the veneer lathe, as apparent from FIG. 15, the axial movement of the stripped core 1*a* is obstructed with the log stoppers 10 when the spindles 2 (2*a*, 2*b*) are retracted and thereby the spindles 2 (2*a*, 2*b*) are withdrawn from the stripped core 1*a* and hence such accidents as mentioned above do not occur and extremely efficient turning operation is attained. Naturally, the log stoppers function effectively not only in removing a stripped core but also in removing a log before the completion of cutting the log if necessary. In either case, the spindles may be retracted while they are rotating.

When a log is barked practically in a regular cylindrical shape before being supplied to the veneer lathe of the present invention, the log is capable of being rotated only by means of the rotary cylinder at the start of the cutting operation and hence the provision of a driving mechanism for the spindles is not necessarily required. However, since most logs have irregular external shapes and hence are not capable of being rotated at the start of the cutting operation only by the rotary roller, it is desirable to provide a spindle driving mechanism, such as a motor, for rotating a log before the slide rest is advanced to make the cutting tool engage with the log. Naturally, a driving force may be transmitted positively from the spindles to the log if necessary. In any case, it is desirable to drive the log principally by the rotary roller and to match the function of the rotary roller and that of the spindles.

Figure 5:
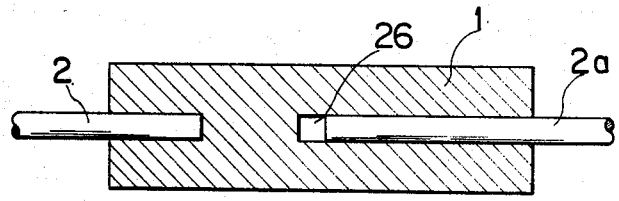
Figure 9:
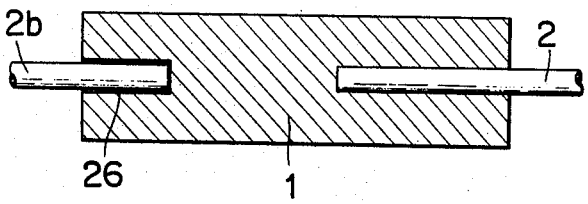
Figure 10:
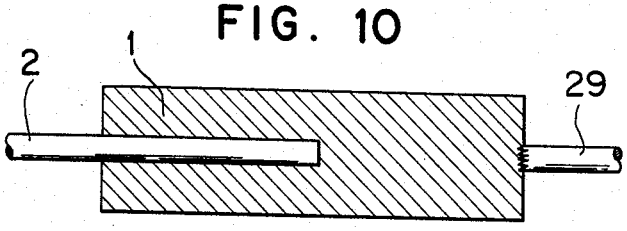

In order to attain stable support of a log, it is desirable to insert both the right and the left spindles into the corresponding center bores of the log as shown, for example, in FIGS. 3 to 9, however, as shown in FIGS. 5 and 9, the respective shapes of the right and the left spindles need not necessarily be identical. Although it is not necessarily desirable, it is possible to support a log 1 on one end thereof with a spindle that fits the center bore formed by the boring mechanism and on the other end thereof with a conventional spindle 29 which is not inserted into the log as shown in FIG. 10.

Figure 11:
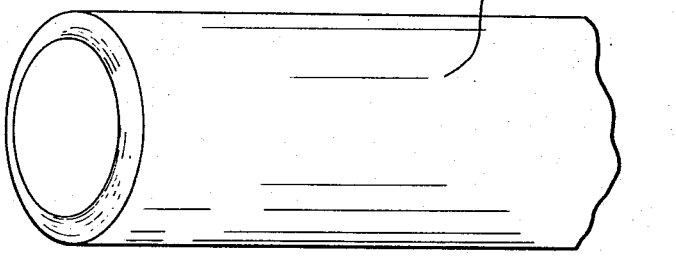
FIGS. 11 to 14 are partial perspective views of various forms of the embodiments of the spindle used in the veneer lathe according to the present invention.
Figure 12:
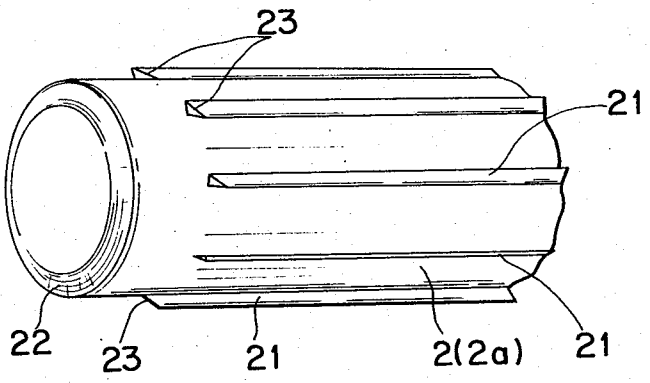
Figure 13:
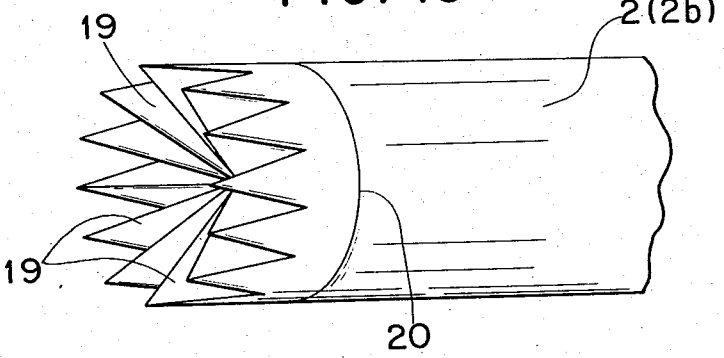
Figure 14:
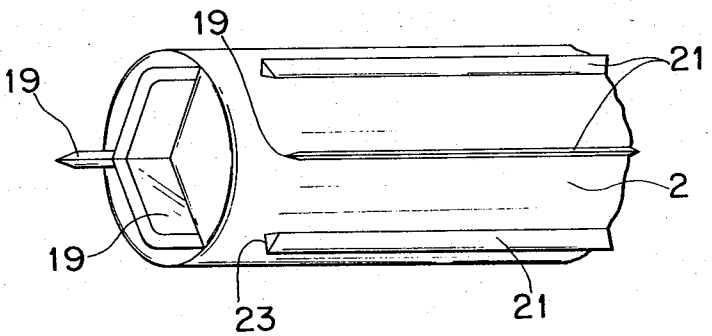

Basically, the form of the part of the spindle which is inserted into the center bore is cylindrical as shown in FIG. 11, however, the form of the spindle is not necessarily limited to a regular cylindrical shape having the same diameter over the entire length thereof, but may be a practically cylindrical shape locally having an increased diameter, such as a screw rod, not shown. Furthermore, the provision, for example, of a plurality of blades 30 of a suitable shape on the circumference of the spindle as shown in FIG. 12, the provision of a plurality of claws 32 of a suitable shape extending from the extremity of the spindle as shown in FIG. 13 or the provision of both a plurality of the blades 30 and a plurality of the sharp claws 32 on the periphery and at the extremity, respectively, of the spindle as shown in FIG. 14 further ensures the firm engagement between the spindle and the center bore and is effective in transmitting a driving force from the spindle to the log as occasion demands.

Naturally, the extremities of the right and the left spindles may be adapted to engage each other in the center bore, if necessary, as shown in FIG. 6. The detachable connection of a front end portion as indicated at 33 in FIG. 13 sill facilitate the replacement of the worn out sharp claws with new ones and the change of the diameter of the front end portion as occasion demands. The detachable connection of the blades to the spindle will also facilitate the replacement of the projections with new ones when worn out. Furthermore, it is desirable to form the edges of the blades 30 in a sharp edge 31 to ensure the smooth insertion of the spindle into the log. In either case, the shapes of the sharp claws and the blades are not limited to those as shown in the drawings, but may essentially be any shape only if the shape is capable of preventing damaging the log and ensuring the firm engagement of the spindle with the log. The dimensional tolerance on the diameter of the spindle that fits the center bore is determined so as to allow errors in the diameter of the center bore attributable to the elastic and the plastic deformations of the wood fibers including drilling error and strain. When the spindle is provided, for example with the blades as shown in FIG. 12 or 14 on the outer periphery thereof, a further increased tolerance on the diameter of the spindle is allowed owing to the pressing effect of the blades.

Furthermore, the pressure members are not limited to those divided fixed bars as shown in FIGS. 1 and 2, but may be comb-shaped fixed bars, divided or comb-shaped rotary rollers or any member provided the member is capable of functioning as a pressure member. In either case, fixing the pressure members to a pressure member holder in the manner of cantilever or in like manner to allow the elastic deformation of the pressure members will allow smooth removal of foreign matters such as bark and wood pieces and adsorption of stress applied thereto due to partial increase in hardness of the log attributable to the presence of gnarls or the like, so that the satisfactory turning of the log is attained.

The shape of the driving members of the rotary roller is not limited to that as illustrated. The shape of the spikes in particular may be, instead of the wedge-shape as illustrated, a needle-shape, a conical shape, a pyramidal shape, an ellipsoidal cone-shape or any other suitable shape. In either case, a shape that allows the spikes to bite into the circumference of the log easily is effective and suitable for transmitting a driving force from the rotary roller to the log. Instead of forming the driving members integrally with the shaft as illustrated, the driving members may be formed separately and detachably mounted on the shaft with space rings placed therebetween. Such a composite constitution or the rotary roller facilitates forming the rotary roller and replacing worn driving members with new ones and hence reduces the manufacturing and the running costs of the rotary roller.

The rotary roller may be disposed so as to allow the spikes to bite only into the periphery of the log near the cutting edge of the cutting tool during cutting operation or so as to allow the spikes to bite into both the periphery of the log near the cutting edge of the cutting tool and the veneer sheet immediately after being cut out from the log. Furthermore, a stripping member of a suitable form, not shown, for removing the veneer sheet and foreign matters from the spikes may be provided after the rotary roller with respect to the direction of rotation of the rotary roller if necessary.

Figure 17:
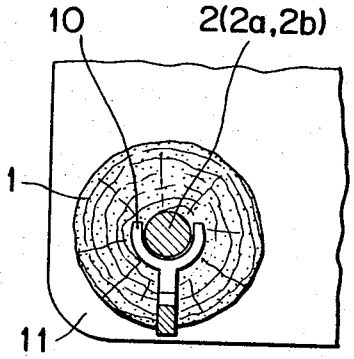
FIG. 17 is a side elevation partly in section of the log stopper of FIG. 16.
Figure 16:
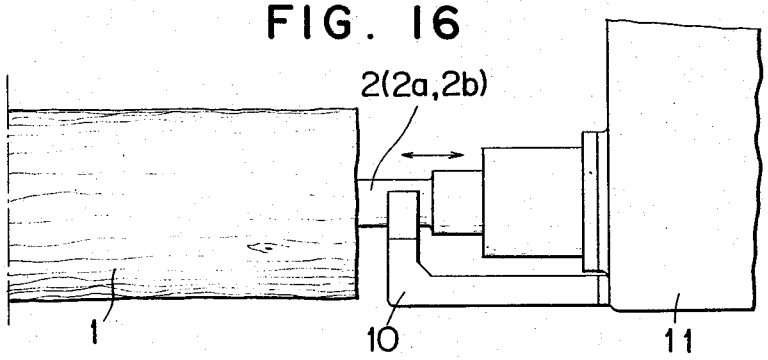
FIG. 16 is a partial plan view of another embodiment of the log stopper according to the present invention.

The log stoppers also are not limited to those of a form as illustrated in FIGS. 1 and 2, but may be a pair of fork ports as illustrated in FIGS. 16 and 17, or rotary annular log stoppers each being fitted on the corresponding spindle and rotatably received in a holder or members of any form so long as the members are capble of allowing the axial movement of the corresponding spindles and of restricting the axial movement of the log within a limited range. Naturally, the log stoppers may be adapted to be movable axially of the spindles or to be movable in the direction of supplying a log or in any suitable direction, or may be formed separably, if necessary. When the right and the left spindles are different in log removability as shown, for example, in FIG. 5 or 9, not to mention when either one of the spindle is formed so as to fit the center bore of a log as shown in FIG. 10, to make the stripped core remain preferentially on one of the spindles, only this particular spindle may be provided with a log stopper.

The boring mechanisms also are not limited to those as illustrated. The boring mechanism may be a mechanism having a boring instrument, such as an electric drill or a pneumatic drill, adapted to be advanced and retracted and a drilling tool, such as a woodworking drill, secured to the boring instrument, or may be a mechanism of any form provided that the mechanism has a boring tool, such as a woodworking drill, adapted to be moved axially of the log and is capable of drilling a center bore in the axial central portion of the log which has previously been centered on a log centering device or a log supply device.

Locations for disposing the boring mechanisms are not limited to the opposite sides of the log centering device as illustrated, but each boring mechanism may be disposed at an intermediate position between the log centering device and the spindles of the veneer lathe as illustrated, for example, the boring mechanism may be disposed by the butt end of a log held on the log supply device for the next supply to the veneer lathe as indicated by continuous line in FIGS. 1 and 2 or may be disposed at any position provided that the boring mechanism is allowed to drill a center bore in the axial central portion of a centered log. Naturally, the log centering device and the log supply device are not limited to those as illustrated, but may, for example, be a log centering device adapted to determine the center axis of a log mainly on the basis of the shapes of both butt ends, a log supply device designed to grip a log at the butt ends thereof in supplying the log to the veneer lathe or any one of known devices including a log centering and supplying device as disclosed in Unexamined Japanese Patent Publication No. 56-11206, "A CLAMPING MECHANISM FOR AUTOMATICALLY CENTERING A STRIPPED CORE IN A ROTARY LATHE". The boring mechanisms may be disposed appropriately in the vicinity of those devices.

A woodworking drill is preferable to a metalworking drill as the drilling tool of the boring mechanism in respect of the chip eliminating capability, however, a metalworking drill also is practically available, and any drilling tool is available provided that the drilling tool is capable of drilling a center bore of a desired form. The bottom surface of the center bore need not be perpendicular to the axis of the center bore.

Although the form of the center bores cannot be specified simply, because the form of the center bore and the form of the spindles are correlated, experimentally, it was found that a center bore of a comparatively small depth is preferable when a spindle of a length reaching the bottom surface of the center bore is used, whereas a center bore of a comparatively large depth is preferable when a spindle having a diameter that fits the center bore is used. In either case, it is preferable that the depth of the center bore is not less than the diameter of the same and more preferable when the depth is 10% of the length of the log or greater. However, excessively deep central bores will require a longer drilling time or will reduce the rigidity of the log and hence they are ineffective.

Chamfering either the edge of the center bore or the extremity of the spindle facilitates the insertion of the spindle into the center bore. Driving the rotary roller at a constant revolving rate results in the production of the veneer sheet at a constant delivery speed, so that the following processes are simplified. Thus, various modifications and modes of practical applications of the present invention are possible. In either case, the veneer lathe according to the present invention is capable of turning a log extremely efficiently to a smaller diameter as compared with the conventional veneer lathe without wasting time for removing the stripped core and is remarkably effective when employed in plywood factories in view of the present and the future log supply conditions under which plywood factories are obliged to use the thin logs of South-Sea woods or to use alternative small diameter logs, due to the depletion of resources.

What is claimed is:

1. A veneer lathe for cutting off veneer sheets from a log comprising a boring unit having a woodworking drill to bore the log at a central portion thereof;

a centering unit provided at a first position in association with said boring unit for centering the log;

spindle means to be inserted into the bored log to support the same rotatably at a second position, said spindle means being provided in parallel to said wood-working drill and adapted for longitudinal movement into and out of said bored log;

conveying means for conveying the bored log from said first position to said second position;

rotary drive means having piercing means therearound and parallelly disposed in facing relation to said log;

a cutting knife having a cutting edge in parallel alignment with said log and the rotary drive means;

pressure means provided slightly ahead of the cutting knife for pressing the log; and means for guiding said spindle means upon said longitudinal movement thereof and stopping accompanying movement of the log.

2. A veneer lathe according to claim 1, wherein said log is bored from opposite ends thereof, said spindle means including a pair of spindles inserted into said bored logs.

3. A veneer lathe according to claim 2, wherein said guiding and stopping means includes a pair of support plates each having an aperture to allow insertion of the rellevant spindle therethrough, said support plates being provided opposite respective longitudinal ends of the log.

4. A veneer lathe according to claim 2, wherein said guiding and stopping means includes a pair of fork posts provided opposite respective longitudinal ends of the log.

5. A veneer lathe according to claim 1, which additionally comprises means to bore a center bore extending longitudinally entirely through the log.

6. A veneer lathe according to claim 1, which additionally comprises means to bore a central cavity from at least one end of said log, and means to insert at least one spindle into said central cavity to snugly fit said bore.

7. A veneer lathe according to claim 1, which additionally comprises means for inserting spindle means into said central bore from each end of said log.

8. A veneer lathe according to claim 1, which additionally comprises means to bore a central cavity from each end of said log extending longitudinally only partially through said log.

9. A veneer lathe according to claim 8, which additionally comprises means to insert at least one spindle into one end of said log to the bottom of said central cavity.

10. A veneer lathe according to claim 1, which additionally comprises means for inserting a spindle means into said central cavity at one end of said log and to employ a spindle means engaging and affixed to the longitudinal other end of said log.

* * * * *